US010900641B1

(12) United States Patent
Lan et al.

(10) Patent No.: US 10,900,641 B1
(45) Date of Patent: Jan. 26, 2021

(54) SIMPLE NET COVER DEVICE AND ITS LAMP

(71) Applicant: SHENZHEN GUANKE TECHNOLOGIES CO., LTD, Shenzhen (CN)

(72) Inventors: Qing Lan, Shenzhen (CN); Yuting Hou, Shenzhen (CN); Ligen Liu, Shenzhen (CN); Shoubao Chen, Shenzhen (CN); Wenhao Lin, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/718,488

(22) Filed: Dec. 18, 2019

(30) Foreign Application Priority Data

Oct. 25, 2019 (CN) ..... 2019 1 1024390

(51) Int. Cl.

| | |
|---|---|
| ***F21V 15/02*** | (2006.01) |
| ***F21V 17/16*** | (2006.01) |
| ***F21V 21/008*** | (2006.01) |
| *F21W 131/10* | (2006.01) |

(52) U.S. Cl.
CPC ..... *F21V 15/02* (2013.01); *F21V 17/16* (2013.01); *F21V 21/008* (2013.01); *F21W 2131/1005* (2013.01)

(58) Field of Classification Search
CPC ..... F21V 15/02; F21V 17/16; F21V 21/008
See application file for complete search history.

(56) References Cited

U.S. PATENT DOCUMENTS 3,626,424 A * 12/1971 Kahn ..... F21V 15/02 362/311.01
2009/0135607 A1* 5/2009 Holloway ..... F21V 25/12 362/362

* cited by examiner

*Primary Examiner* — Thomas M Sember
(74) *Attorney, Agent, or Firm* — Maier & Maier, PLLC

(57) ABSTRACT

A simple net cover device that includes a connecting plate, a cover body and a bottom fixing part. The cover body is set between the connecting plate and the bottom fixing part. The cover body includes the first end part and the second end part. The first end part is embedded into the connecting plate to locate the cover body and the connecting plate. The second end part is fixedly connected to the bottom fixing part. The simple net cover device is characterized by simple processing and assembly, low manufacture cost, not easy to wear in bottom and long life, and can ensure the net cover is supported. The present invention also provides a lamp including the simple net cover device, which can not only be used alone, but also can be strung into a string of lamps to meet the diversified use needs of the users.

6 Claims, 9 Drawing Sheets

SIMPLE NET COVER DEVICE AND ITS LAMP

CROSS-REFERENCE TO RELATED APPLICATIONS

This application claims the priority of Chinese Patent Application No. 201911024390.5 filed on Oct. 25, 2019, the disclosure of which is incorporated herein by reference.

FIELD

The present invention relates to the field of lamps, in particular to a simple net cover device and its lamps.

BACKGROUND

The working lamp generally has a metal net cover to improve the structure strength and protective performance of the lamp. The net cover, if designed in the bottom of the working lamp, can play a role of support, so that it can be used on the horizontal plane. In order to reduce the cost of metal net cover in the industry, the metals with poor rust prevention capability are generally selected, such as iron, stainless steel, etc. The net cover processed by the materials cannot be directly used, and one or more surface treatment is required to improve the anti-rust performance, such as electroplating, powder spraying, etc. Because the working lamp needs to be used repeatedly and recycled, this causes the bottom of the net cover to be easily worn and destroy the rust-proof layer, thus speeding up the rust and corrosive damage of the net cover. In addition, the existing net cover is usually fixed to the lamp by the connecting plate or screw post designed at one end of the net cover, and the corresponding net cover installation structure leads to the complex processing and high cost of the net cover. At the same time, the net cover is a non-standard part welded manually. Because of the poor manual welding precision, the height difference of different supporting legs of the net cover exceeds 1 mm, leading to the uneven net cover support.

Moreover, the existing working lamp cannot meet the diversified demand of the existing market due to the less application scenarios.

SUMMARY

In order to solve the above problems, the present invention proposes a kind of simple net cover device and its lamps. The simple net cover device is characterized by simple processing and assembly, low manufacture cost, not easy to wear in bottom and long life, and can ensure the net cover supported flat; the lamp can not only be used alone, but also can be strung into a string of lamps to meet the diversified use needs of the users.

The present invention is realized by the following technical scheme:

The present invention provides a simple net cover device for lamp protection that comprises a connecting plate, a cover body and a bottom fixing part. The cover body is set between the connecting plate and the bottom fixing part. The cover body includes the first end part and the second end part. The first end part is embedded into the connecting plate to locate the cover body and the connecting plate. The second end part is fixedly connected to the bottom fixing part.

Further, the cover body includes an accommodating cavity and the connecting plate is provided at least one diversion hole that is connected to the accommodating cavity.

Further, the second end part includes a plurality of supporting legs. The bottom fixing part is provided with a plurality of supporting parts. The supporting leg is fixed in the corresponding said supporting part.

Further, the cover body includes an accommodating cavity, a plurality of the supporting parts together form a diversion area which is connected with the accommodating cavity, and the adjacent two said supporting parts form a fan section connected to the diversion area.

Further, each said supporting part is provided with supporting surfaces for supporting that are in the same horizontal line.

Further, the adjacent two said supporting parts are connected with curved plate.

The present invention also provides a lamp that includes a lamp body, a power shell, a simple net cover device said above, the connecting plate is firmly installed between the power shell and the lamp body, the cover body and the bottom fixing part are covered in the periphery of the lamp body, and the power shell and the connecting plate constitute the lamp housing.

Further, the lamp housing has at least one serial interface for electric connection, the lamp also includes a side cover which is flexibly connected to the lamp housing, and the side cover may move relative to the lamp housing to open or close the serial interface.

Further, the side cover has the first buckle and the power shell has the second buckle. When the side cover covers the serial interface, the first buckle covers the second buckle.

Further, the lamp body comprises a radiator, a side lamp region arranged at the side of the radiator and a bottom lamp region arranged at the bottom of the radiator. The side lamp region comprises side lamp panel and the bottom lamp region comprises bottom lamp panel. The side lamp panel is inserted in the bottom lamp panel to achieve the electrical connection between the side lamp panel and the bottom lamp panel.

Further, the radiator has a heat dissipation channel which is connected with the diversion hole, the bottom lamp region also comprises an inducer installed in the diversion area, the inducer has the heat dissipation hole which is connected with the heat dissipation channel, and the diversion hole, the heat dissipation channel and the heat dissipation hole form a heat dissipation diversion channel.

Further, the inducer has an intelligent control extension interface which is used to control the lamp, the lamp housing has a driving power supply, and the intelligent control extension interface is electrically connected to the driving power supply.

Beneficial Effect of the Present Invention

The present invention provides a simple net cover device that comprises a connecting plate, a cover body and a bottom fixing part. The cover body is set between the connecting plate and the bottom fixing part. The cover body includes the first end part and the second end part. The first end part is embedded into the connecting plate to locate the cover body and the connecting plate. The second end part is fixedly connected to the bottom fixing part. The simple net cover device of the present invention is characterized by simple processing and assembly, low manufacture cost, not easy to wear in bottom and long life, and can ensure the net cover supported flat. The present invention also provides a lamp including the simple net cover device, which can not only be used alone, but also can be strung into a string of lamps to meet the diversified use needs of the users.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

DETAILED DESCRIPTION

In order to explain the technical scheme of the present invention more clearly and completely, the present invention is further explained in combination with the drawings.

Figure 1:
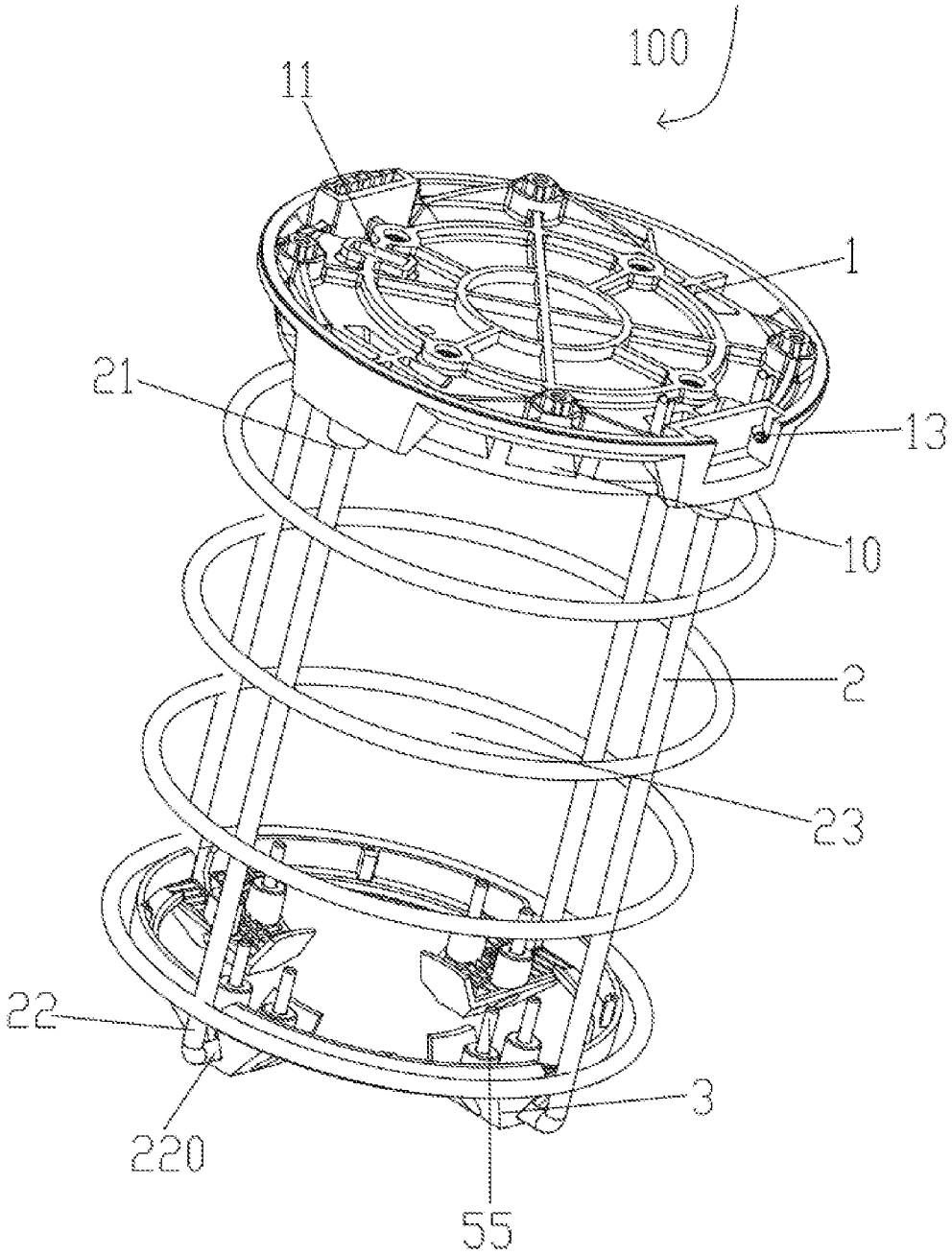
FIG. 1 is the structure diagram of simple net cover device in the present invention.
Figure 2:
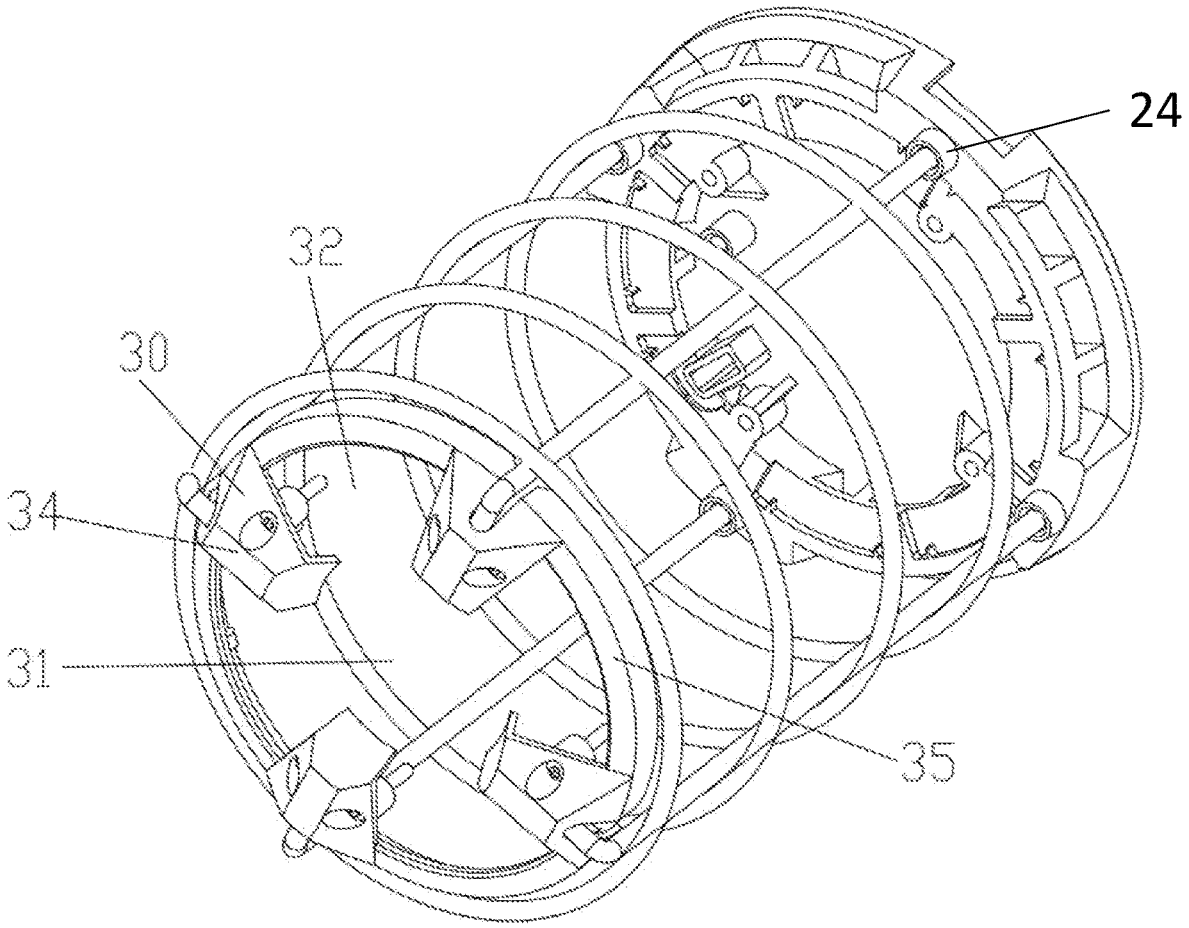
FIG. 2 is the structure diagram of simple net cover device in the present invention.
Figure 3:
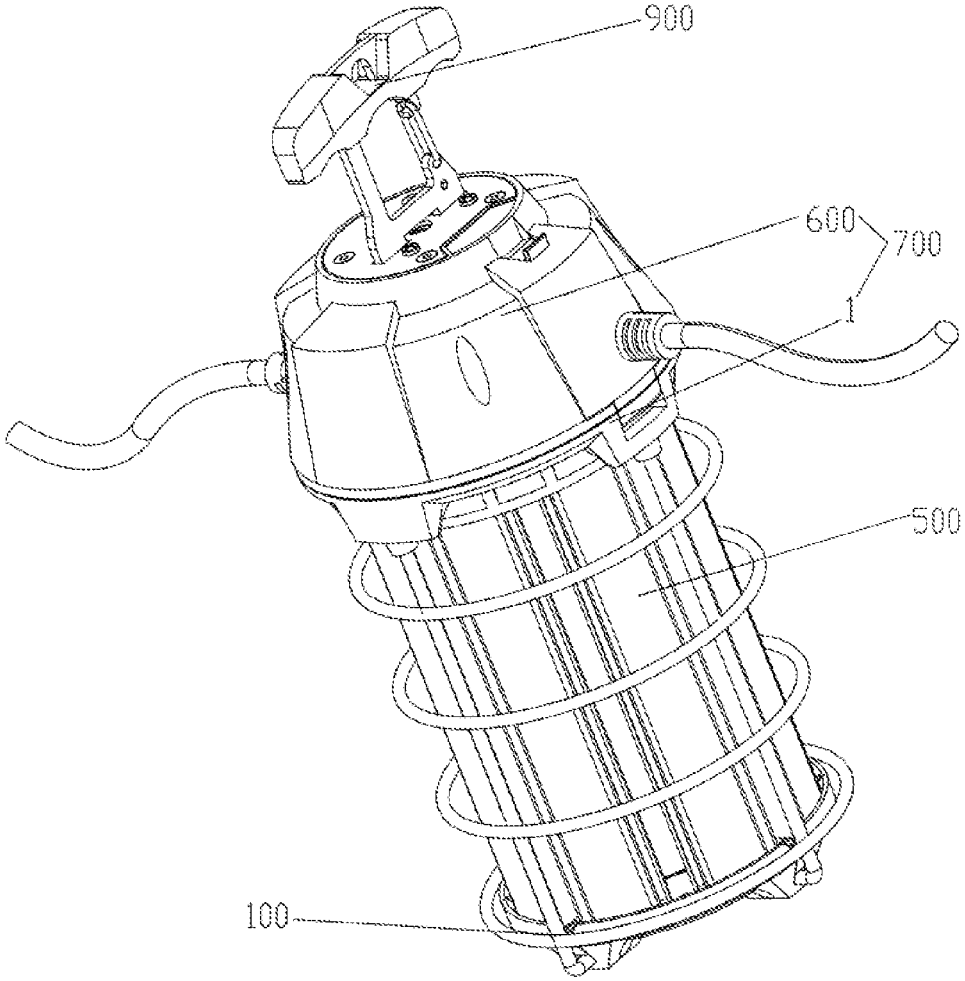
FIG. 3 is the structure diagram of lamp in the present invention.
Figure 4:
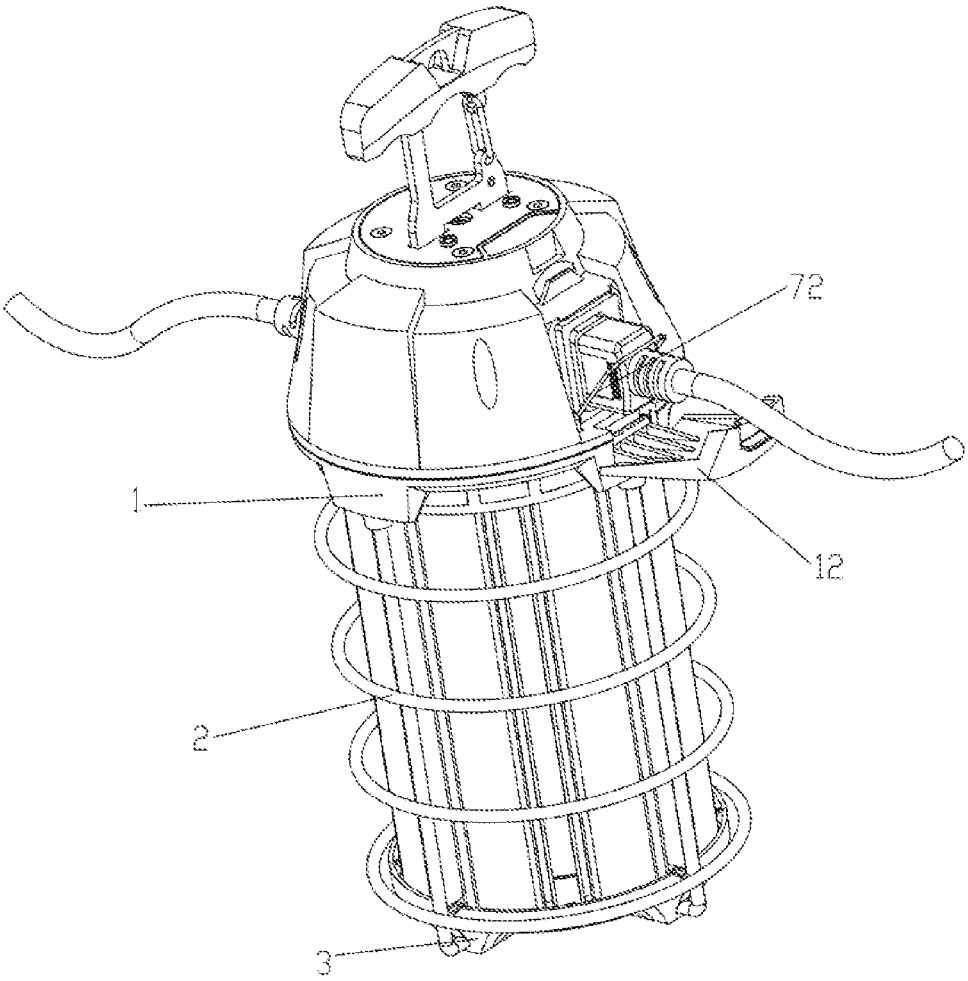
FIG. 4 is the structure diagram of lamp in the present invention.
Figure 5:
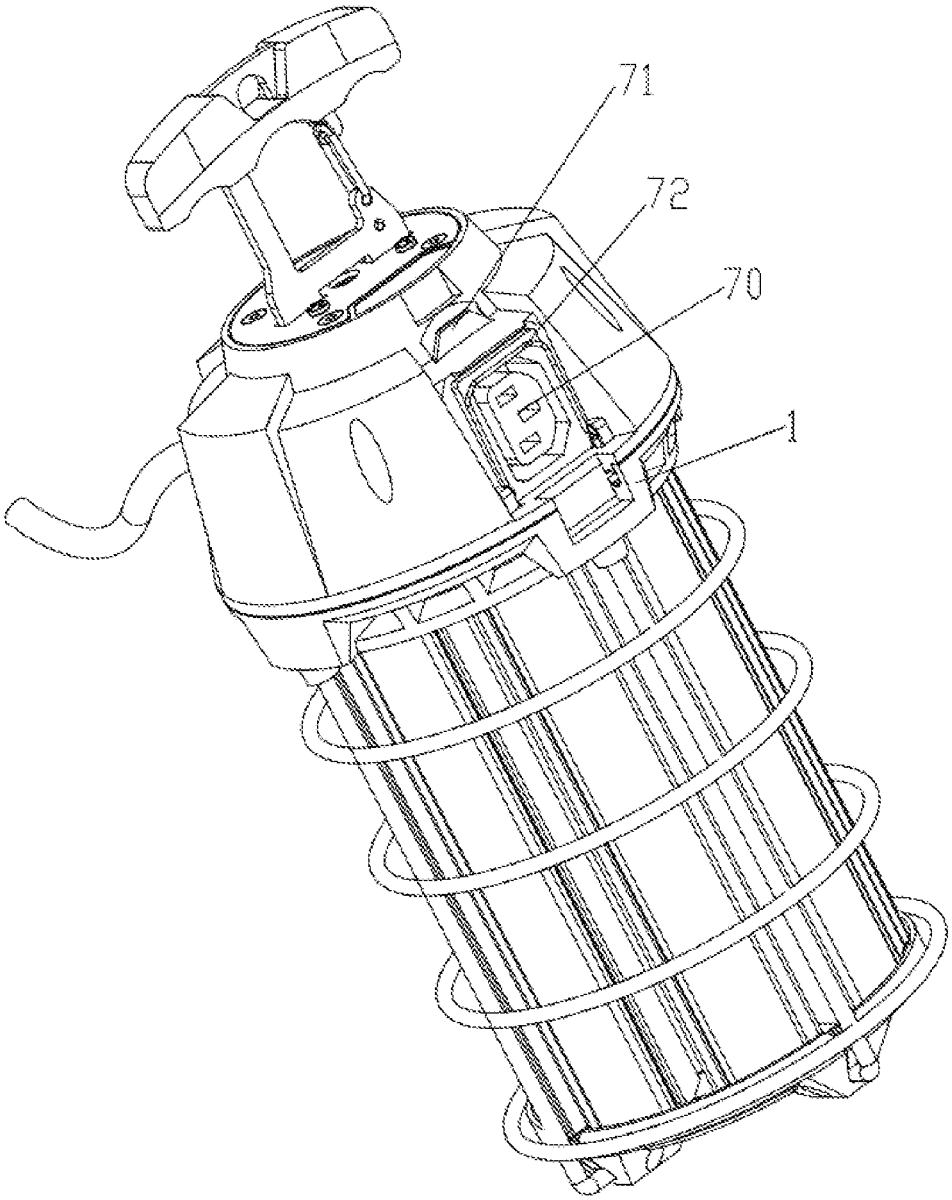
FIG. 5 is the structure diagram of lamp in the present invention.
Figure 6:
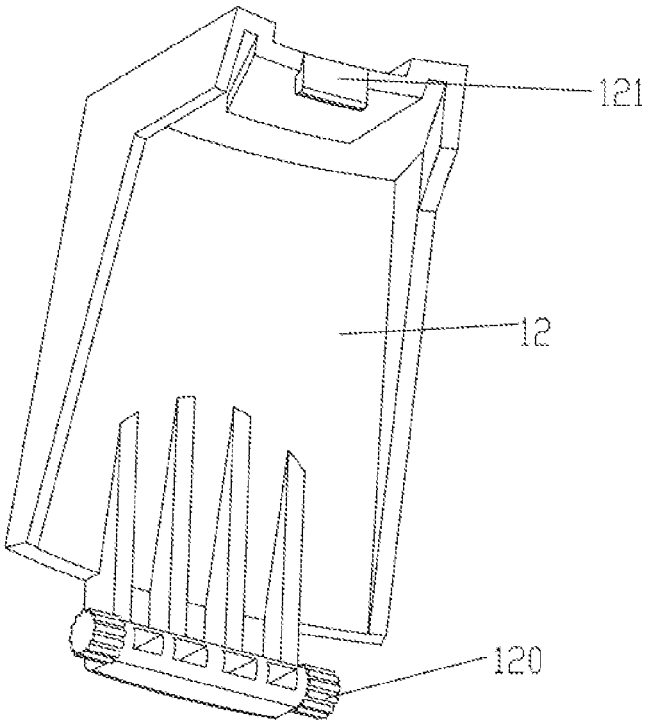
FIG. 6 is the structure diagram of side cover of the lamp in the present invention.
Figure 7:
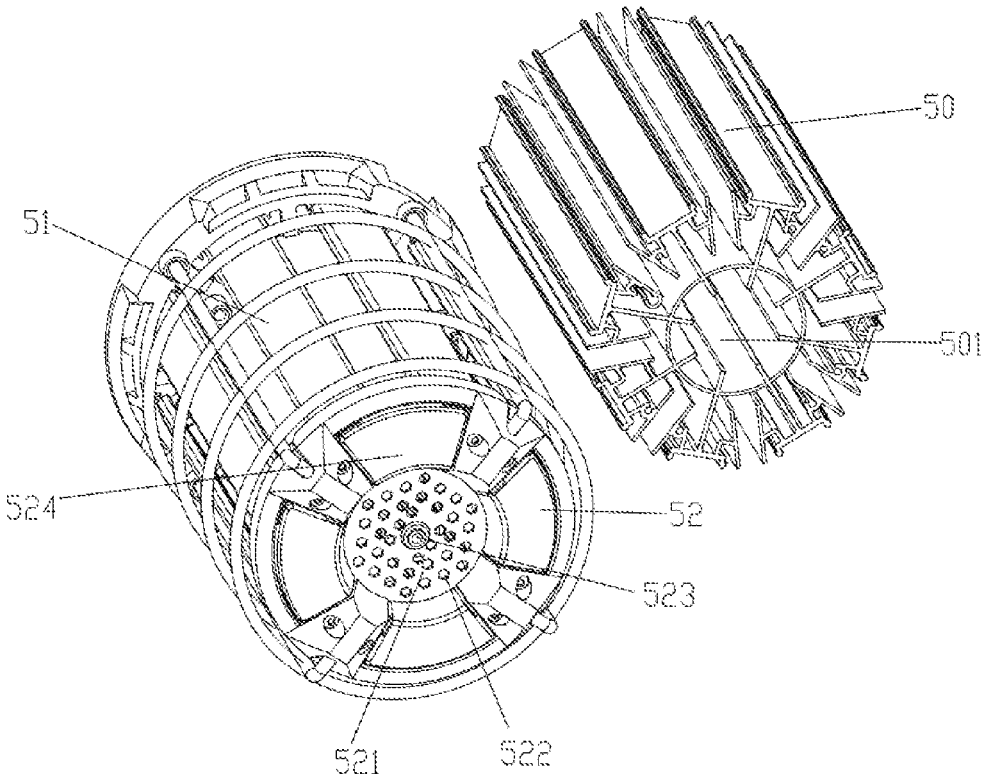
FIG. 7 is the schematic diagram of structural decomposition of lamp body of the lamp in the present invention.
Figure 8:
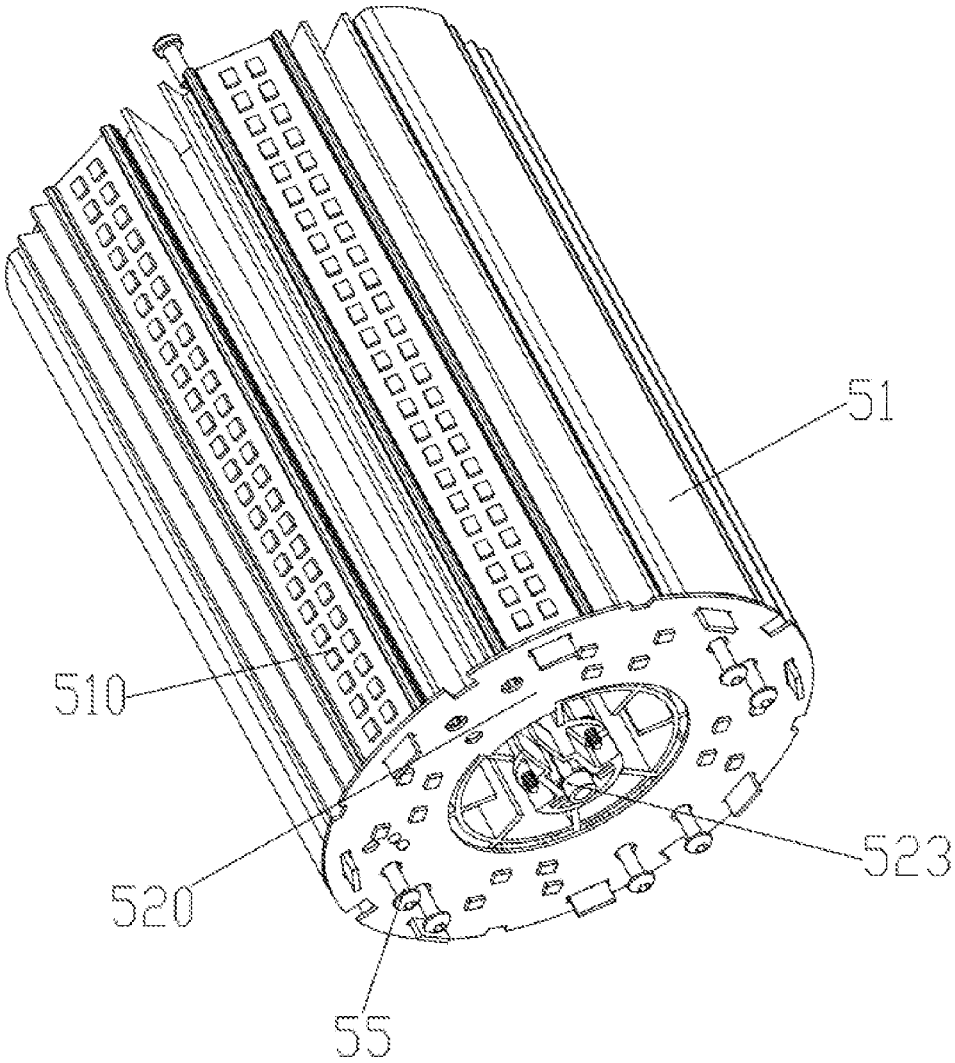
FIG. 8 is the part structure diagram of lamp body of the lamp in the present invention.
Figure 9:
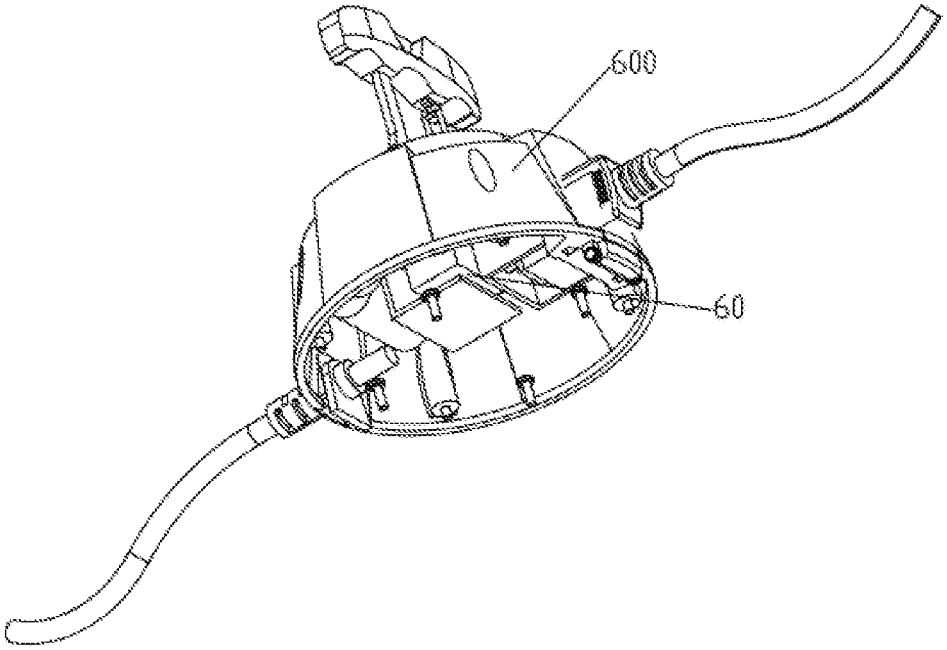
FIG. 9 is the part structure diagram of lamp in the present invention.

Referring to FIG. 1 to FIG. 2, the present invention provides a simple net cover device 100 that comprises a connecting plate 1, a cover body 2 and a bottom fixing part 3. The cover body 2 is set between the connecting plate 1 and the bottom fixing part 3. The cover body 2 includes the first end part 21 and the second end part 22. The first end part 21 is embedded into the connecting plate 1 to locate the cover body 2 and the connecting plate 1. The second end part 22 is fixedly connected to the bottom fixing part 3.

In the present embodiment, compared with that the existing net cover taps screw at the end and is firmly connected to the lamp in the fixing form of screw, the first end part 21 of the cover body 2 in the present invention only needs to be inserted into the slots 24 of the connecting plate 1 to complete the positioning and fixing, and as such, additional fixing is not required in the contact position between the first end part 21 and the connecting plate 1. Cover body 2 is fastened with the screw 55 on the bottom fixing part 3 and the lamp body of the lamp. But because the bottom of lamp body 500 fastens the bottom luminous module with screw 55, the bottom fixing part 3 can use the ready-made screw 55 to fasten with the lamp body 500. Namely, the fixing of the cover body 3 is divided into the positioning and the fastening in different positions. Because the fastening is common, it is equivalent to saving a fastening process of the cover body 2, so that the simple net cover device of the present invention can be assembled faster and the structure of the cover body 2 can be simpler.

In the present embodiment, compared with the existing net cover as a whole metal design, when the net cover is supported on the ground, the contact part with the ground is easy to wear, so that the bottom of the net cover is worn, the problem of rust is caused, the service life is reduced, and the aesthetic property of the use is influenced. In the present invention, the second end part 22 of the cover body 2 is firmly connected to the bottom fixing part 3. When it is supported on the ground, the bottom fixing part 3 is in contact with the ground to avoid direct contact of the second end part 22 with the ground. The bottom fixing part 3 may be an injection molded part or a die pressing part, so that the bottom part of the simple net cover device 100 of the present invention can be prevented from being worn, and the rust prevention capability of the net cover is improved.

Further, the cover body 2 includes an accommodating cavity 23 and the connecting plate 1 is provided at least one diversion hole 10 that is connected to the accommodating cavity 23.

Further, the second end part 22 includes a plurality of supporting legs 220. The bottom fixing part 3 is provided with a plurality of supporting parts 30. The supporting leg 220 is fixed in the corresponding said supporting part 30. The quantity of the supporting leg 220 is corresponding to that of the supporting part 30.

Further, a plurality of the supporting parts 30 together form a diversion area 31 which is connected with the accommodating cavity 23, and the adjacent two said supporting parts 30 form a fan section 32 connected to the diversion area 31. The diversion area 31 is circular and the fan section 32 is connected with the accommodating cavity 23.

Further, each said supporting part 30 is provided with supporting surfaces 34 for supporting that are in the same horizontal line.

In the present embodiment, the existing net cover forms a circle in the bottom by means of manual welding. Because of the poor manual welding precision, the height difference of different supporting legs 220 of the net cover exceeds 1 mm, leading to the uneven net cover support. In the present invention, each said supporting part 30 is provided with supporting surfaces 34 for supporting that are in the same horizontal line, which can ensure the simple net cover device 100 supported flatly.

Further, the adjacent two said supporting parts 30 are connected with a curved plate 35.

Referring to FIG. 3 to FIG. 9, the present invention also provides a kind of lamp, including lamp body 500, power shell 600 and the simple net cover device 100. The connecting plate 1 is firmly installed between the power shell 600 and the lamp 500, the cover body 2 and the bottom fixing part 3 are covered in the periphery of the lamp 500. Namely, the lamp body 500 is accommodated in the accommodating cavity 23 and the power shell 600 and the connecting plate 1 form the lamp housing 700 of the lamp.

The lamp also comprises the mounting part 900 that is firmly connected to the lamp housing 700 and the mounting part is used to externally install the lamp.

In the present embodiment, the simple net cover device 100 is used to protect the lamp body 500 and may improve the lamp's structure strength and protective performance. The bottom fixing part 3 of the simple net cover device 100 is set in the bottom of the working lamp and can play a role of support.

In the present embodiment, the connecting plate 1 is provided with the wiring hole 11 that is connected with the accommodating cavity 23, and the lamp housing 700 is electrically connected to the lamp body 500 through the wiring hole 11.

Further, the lamp housing 700 is provided with at least one serial interface 70 for electrical connection, the lamp also includes a side cover 12 which is flexibly connected to the lamp housing 700, and the side cover 12 may move relative to the lamp housing 700 to open or close the serial interface 70.

In the present embodiment, the serial interface 70 may be used for electrical connection between the mains and the lamp and may also be used for electrical connection between the lamps, so that the lamp in the present invention can not only be used alone, but also can be strung into a string of lamps to meet the diversified use needs of the users.

In the present embodiment, the side cover 12 includes a rotating shaft 120, the connecting plate 1 has a rotating hole 13, the rotating shaft 120 is movably mounted in the rotating hole 13. The matching of the rotating shaft 120 and the rotating hole 13 makes the side cover 12 rotate relative to the connecting plate 1 to open or close the serial interface 70. The rotating shaft 120 is designed below the junction interface between the power shell 600 and the connecting plate 1, which can reduce the risk of rainwater entering the interior of the lamp housing 700. The lamp housing 700 is provided with the anti-tripping buckle 72 that can prevent the series plug from separating from the serial interface 70, and the anti-tripping buckle 72 can rotate relative to the serial interface 70.

Further, the side cover 12 is provided with the first buckle 121, and the power shell 600 is provided with the second buckle 71. When the side cover 12 covers the serial interface 70, the first buckle 121 is covered on the second buckle 71.

In the present embodiment, the matching of the first buckle 121 and the second buckle 71 makes that the side cover 12 firmly connect the lamp housing 700, so that the side cover 12 maintains the state of covering the serial interface 70 under the action of other external forces.

Further, the lamp body 500 comprises a radiator 50, a side lamp region 51 arranged at the side of the radiator 50 and a bottom lamp region 52 arranged at the bottom of the radiator 50. The side lamp region 51 comprises side lamp panel 510 and the bottom lamp region 52 comprises bottom lamp panel 520. The side lamp panel 510 is inserted in the bottom lamp panel 520 to achieve the electrical connection between the side lamp panel 510 and the bottom lamp panel 520.

In the present embodiment, there is a plurality of side lamp regions 51 that are evenly distributed on the side of the radiator 50, so that the lamp has 360° luminous angle. The side lamp panel 510 is inserted in the bottom lamp panel 520 to achieve the electrical connection between the side lamp panel 510 and the bottom lamp panel 520. This design can save the wiring board and simplify the structure of lamps.

Further, the radiator 50 has a heat dissipation channel 501 which is connected with the diversion hole 10.

In the present embodiment, there is a plurality of diversion holes 10 that are connected with the heat dissipation channel 501.

Further, the bottom lamp region 52 also comprises an inducer 521 installed in the diversion area 31, and the inducer 521 has the heat dissipation hole 522 which is connected with the heat dissipation channel 501; the diversion hole 10, the heat dissipation channel 501 and the heat dissipation hole 522 form a heat dissipation diversion channel which can effectively dissipate the heat of the lamp body 500. The inducer 521 is sealed at the end of the heat dissipation channel 501. The bottom lamp region 52 also includes the bottom lamp cover 524 that covers the bottom lamp panel 520 and the bottom lamp cover 524 is installed in the fan section 32.

Further, the inducer 521 has an intelligent control extension interface 523 which is used to control the lamp, the lamp housing 700 has a driving power supply 60, and the intelligent control extension interface 523 is electrically connected to the driving power supply 60.

In the present embodiment, the wireless control of the lamp through the intelligent control extension interface 523 can control the lamp on/off/dimming, and achieve intelligent control, simple operation, more adapted scenes and wider scopes.

Of course, there are other embodiments of the present invention. Based on the present embodiment, all other embodiments acquired by the common technicians in this field without creative work, shall be in the protection scope of the present invention.

What is claimed is:

1. A lamp comprising:

a lamp body;

a power shell;

a simple net cover device comprising a connecting plate;

a cover body; and a bottom fixing part, wherein the cover body is set between the connecting plate and the bottom fixing part and the cover body includes a first end part and a second end part, wherein the first end part is slidably retained by slots provided in the connecting plate to locate the cover body and the connecting plate, wherein the second end part is fixedly connected to a bottom fixing part, and wherein the connecting plate is firmly installed between the power shell and the lamp body, the cover body and the bottom fixing part are covered in a periphery of the lamp body, and the power shell and the connecting plate form a lamp housing.

2. The lamp as in claim 1, wherein the lamp body comprises a radiator, a side lamp region arranged at a side of the radiator and a bottom lamp region arranged at a bottom of the radiator, the side lamp region comprises a side lamp panel and the bottom lamp region comprises a bottom lamp panel, the side lamp panel is inserted in the bottom lamp panel to achieve an electrical connection between the side lamp panel and the bottom lamp panel.

3. The lamp as in claim 2, wherein the radiator has a heat dissipation channel which is connected with the diversion hole;

the bottom lamp region also comprises an inducer installed in the diversion area;

the inducer has a heat dissipation hole which is connected with the heat dissipation channel; and the at least one diversion hole, the heat dissipation channel, and the heat dissipation hole form a heat dissipation diversion channel.

4. The lamp as in claim 3, wherein the inducer has an intelligent control extension interface which is used to control the lamp, the lamp housing has a driving power supply, and the intelligent control extension interface is electrically connected to the driving power supply.

5. A lamp comprising:

a lamp body;

a power shell;

a simple net cover device comprising a connecting plate;

a cover body; and a bottom fixing part, wherein the cover body is set between the connecting plate and the bottom fixing part and the cover body includes a first end part and a second end part, wherein the first end part is slidably retained by slots provided in the connecting plate to locate the cover body and the connecting plate, wherein the second end part is fixedly connected to a bottom fixing part, wherein the connecting plate is firmly installed between the power shell and the lamp body, the cover body and the bottom fixing part are covered in a periphery of the lamp body, and the power shell and the connecting plate form a lamp housing, wherein the lamp housing has at least one serial interface for an electric connection, wherein the lamp includes a side cover which is flexibly connected to the lamp housing, and wherein the side cover may move relative to the lamp housing to open or close the serial interface.

6. The lamp as in claim 5, wherein the side cover has a first buckle and the power shell has a second buckle, and when the side cover covers the serial interface, the first buckle covers the second buckle.

* * * * *